US008439749B2

(12) United States Patent
Anderson et al.

(10) Patent No.: US 8,439,749 B2
(45) **Date of Patent: *May 14, 2013**

(54) GAMING SYSTEM HAVING TOOLS FOR PAIRING WAGERING GAMES WITH AVAILABLE PROGRESSIVE GAMES

(75) Inventors: Peter R. Anderson, Glenview, IL (US); Damon E. Gura, Chicago, IL (US); Kyle G. Nyenhuis, Madison, WI (US); Erhard W. Rathsack, Reno, NV (US); Saravanan Saravanan, Palatine, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/585,489

(22) Filed: Aug. 14, 2012

(65) Prior Publication Data

US 2012/0309508 A1 Dec. 6, 2012

Related U.S. Application Data

(63) Continuation of application No. 12/812,493, filed as application No. PCT/US2009/030628 on Jan. 9, 2009, now Pat. No. 8,323,101.

(60) Provisional application No. 61/011,040, filed on Jan. 14, 2008.

(51) Int. Cl.
*A63F 9/24* (2006.01)

(52) U.S. Cl.
USPC ..... 463/27

(58) Field of Classification Search ..... 463/27
See application file for complete search history.

(56) References Cited

U.S. PATENT DOCUMENTS 4,861,041 A 8/1989 Jones et al. ..... 273/292
4,964,638 A 10/1990 Ishida ..... 273/138 A (Continued)

FOREIGN PATENT DOCUMENTS

AU 5251830 12/2005
WO 96/11730 4/1996

(Continued)

OTHER PUBLICATIONS

International Search Report mailed Mar. 2, 2009 which issued in corresponding to International Patent Application No. PCT/US2009/030628 (2 pages).

(Continued)

*Primary Examiner* — Pierre E Elisca
(74) *Attorney, Agent, or Firm* — Nixon Peabody LLP

(57) ABSTRACT

Gaming devices, gaming systems, methods of conducting wagering games, and computer programs for conducting wagering games are disclosed. A gaming system for playing a wagering game is disclosed which includes a processor(s) and a memory device(s) storing instructions that, when executed by at least one of the processors, cause the gaming system to: store, on at least one memory device, a progressive game having a first set of configuration parameters; store, on at least one memory device, a primary wagering game having a second set of configuration parameters; and compare, via at least one processor, the first set of configuration parameters with the second set of configuration parameters to determine, in accordance with at least a first rule set, if the primary wagering game can be activated and paired with the progressive game.

24 Claims, 9 Drawing Sheets

U.S. PATENT DOCUMENTS

| | | | | |
|---|---|---|---|---|
| 5,042,810 | A | 8/1991 | Williams | 273/142 |
| 5,083,271 | A | 1/1992 | Thacher et al. | 341/411 |
| 5,116,055 | A | 5/1992 | Tracy | 273/138 A |
| 5,249,800 | A | 10/1993 | Hilgendorf et al. | 273/138 A |
| 5,280,909 | A | 1/1994 | Tracy | 273/138 A |
| 5,344,144 | A | 9/1994 | Canon | 273/138 A |
| 5,564,700 | A | 10/1996 | Celona | 463/27 |
| 5,580,309 | A | 12/1996 | Piechowiak et al. | 463/16 |
| 5,588,650 | A | 12/1996 | Eman et al. | 273/142 B |
| 5,611,730 | A | 3/1997 | Weiss | 463/20 |
| 5,655,961 | A | 8/1997 | Acres et al. | 463/27 |
| 5,743,523 | A | 4/1998 | Kelly et al. | 273/138.1 |
| 5,761,649 | A | 6/1998 | Hill | 705/27 |
| 5,851,149 | A | 12/1998 | Xidos et al. | 463/42 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 6,012,982 | A | 1/2000 | Piechowiak et al. | 463/16 |
| 6,089,980 | A | 7/2000 | Gauselmann | 463/27 |
| 6,110,043 | A | 8/2000 | Olsen | 463/27 |
| 6,146,273 | A | 11/2000 | Olsen | 463/27 |
| 6,241,608 | B1 | 6/2001 | Torango | 463/27 |
| RE37,885 | E | 10/2002 | Acres et al. | 463/42 |
| 6,592,460 | B2 | 7/2003 | Torango | 463/27 |
| 6,645,077 | B2 | 11/2003 | Rowe | 463/42 |
| RE38,812 | E | 10/2005 | Acres et al. | 463/26 |
| 7,056,215 | B1 | 6/2006 | Olive | 463/27 |
| 7,108,603 | B2 | 9/2006 | Olive | 463/27 |
| 7,144,321 | B2 | 12/2006 | Mayeroff | 463/16 |
| 7,285,049 | B1 | 10/2007 | Luciano, Jr. et al. | 463/42 |
| 7,896,741 | B2 * | 3/2011 | Kuehling et al. | 463/29 |
| 2005/0054419 | A1 | 3/2005 | Souza et al. | 463/20 |
| 2006/0073887 | A1 | 4/2006 | Nguyen et al. | 463/27 |
| 2006/0073888 | A1 | 4/2006 | Nguyen et al. | 463/27 |
| 2006/0142079 | A1 | 6/2006 | Ikehara et al. | 463/27 |
| 2007/0060314 | A1 | 3/2007 | Baerlocher et al. | 463/25 |
| 2007/0060321 | A1 | 3/2007 | Vasquez et al. | 463/27 |
| 2007/0077990 | A1 | 4/2007 | Cuddy et al. | 463/25 |
| 2007/0191088 | A1 | 8/2007 | Breckner et al. | 463/20 |
| 2007/0259709 | A1 | 11/2007 | Kelly et al. | 463/20 |
| 2007/0293293 | A1 | 12/2007 | Baerlocher et al. | 463/16 |
| 2007/0298857 | A1 | 12/2007 | Schlottmann et al. | 463/16 |
| 2007/0298874 | A1 | 12/2007 | Baerlocher et al. | 463/27 |
| 2007/0298875 | A1 | 12/2007 | Baerlocher et al. | 463/27 |
| 2008/0020830 | A1 | 1/2008 | Ikehara et al. | 463/27 |
| 2008/0020831 | A1 | 1/2008 | Ikehara et al. | 463/27 |
| 2008/0020832 | A1 | 1/2008 | Iddings et al. | 463/27 |
| 2008/0020833 | A1 | 1/2008 | Baerlocher et al. | 463/27 |
| 2008/0020834 | A1 | 1/2008 | Breckner et al. | 463/27 |
| 2008/0020846 | A1 | 1/2008 | Vasquez et al. | 463/42 |
| 2008/0045344 | A1 | 2/2008 | Schlottmann et al. | 463/42 |
| 2008/0064502 | A1 | 3/2008 | Schlottmann et al. | 463/42 |
| 2008/0070680 | A1 | 3/2008 | Baerlocher et al. | 463/27 |
| 2008/0070692 | A1 | 3/2008 | Schlottmann et al. | 463/42 |
| 2008/0070693 | A1 | 3/2008 | Schlottmann et al. | 463/42 |
| 2008/0070694 | A1 | 3/2008 | Schlottmann et al. | 463/42 |
| 2008/0070695 | A1 | 3/2008 | Baerlocher et al. | 463/42 |
| 2008/0070702 | A1 * | 3/2008 | Kaminkow et al. | 463/46 |
| 2008/0076514 | A1 | 3/2008 | Baerlocher et al. | 463/20 |
| 2008/0076515 | A1 | 3/2008 | Baerlocher et al. | 463/20 |
| 2008/0076517 | A1 | 3/2008 | Baerlocher et al. | 463/20 |
| 2008/0076547 | A1 * | 3/2008 | Bigelow et al. | 463/29 |
| 2008/0076552 | A1 | 3/2008 | Baerlocher et al. | 463/31 |
| 2009/0325686 | A1 * | 12/2009 | Davis et al. | 463/25 |
| 2012/0046110 | A1 * | 2/2012 | Amaitis et al. | 463/42 |
| 2012/0058814 | A1 * | 3/2012 | Lutnick et al. | 463/25 |
| 2012/0172123 | A1 * | 7/2012 | Beaulieu et al. | 463/31 |

FOREIGN PATENT DOCUMENTS

| | | |
|---|---|---|
| WO | 97/12338 | 4/1997 |
| WO | 97/27568 | 7/1997 |
| WO | 2005/120672 | 12/2005 |
| WO | 2006/076185 | 7/2006 |
| WO | 2007/139988 | 12/2007 |
| WO | 2008/030904 | 3/2008 |
| WO | 2008/060426 | 5/2008 |
| WO | 2008/060442 | 5/2008 |
| WO | 2008/060459 | 5/2008 |
| WO | 2008/060513 | 5/2008 |
| WO | 2008/063408 | 5/2008 |

OTHER PUBLICATIONS

Written Opinion mailed Mar. 2, 2009 which issued in corresponding to International Patent Application No. PCT/US2009/030628 (5 pages).

* cited by examiner

GAMING SYSTEM HAVING TOOLS FOR PAIRING WAGERING GAMES WITH AVAILABLE PROGRESSIVE GAMES

CLAIM OF PRIORITY AND CROSS-REFERENCE TO RELATED APPLICATIONS

This application is a Continuation of U.S. patent application Ser. No. 12/812,493, which was filed on Jul. 12, 2010, as a U.S. National Phase of International Application No. PCT/US2009/030628, which was filed on Jan. 9, 2009, and claims the benefit of and priority to U.S. Provisional Patent Application No. 61/011,040, filed Jan. 14, 2008, all of which are incorporated herein by reference in their respective entireties and for all purposes.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present disclosure relates generally to gaming machines, and methods for playing wagering games, and more particularly, to a gaming system having tools for pairing wagering games with available progressive games.

BACKGROUND

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, many designers continue to develop gaming systems with new types of bonus games to satisfy the demands of players and operators.

Progressive awards and jackpots are used to increase anticipation and excitement as such jackpots grow over time and entice players to engage in further game play.

SUMMARY

According to one aspect of the present disclosure, a method of operating a wagering game comprises activating a progressive game having a first set of configuration parameters and providing a primary wagering game having a second set of configuration parameters. The method further comprises comparing the first set of configuration parameters with the second set of configuration parameters to determine, in accordance with at least a first rule set, if the primary wagering game can be activated and paired with the progressive game. The method further displays results from the comparing step.

According to another aspect of the disclosure, a method of operating a gaming system comprises providing a progressive game having a first set of configuration parameters and activating a primary wagering game having a second set of configuration parameters. The method further comprises comparing the second set of configuration parameters with the first set of configuration parameters to determine, in accordance with at least a first rule set, if the progressive game can be activated and paired with the primary wagering game. The method further displays results from the comparing step.

According to yet another aspect of the disclosure, a method of pairing progressive games with primary wagering games comprises providing a plurality of progressive games, each having a first set of configuration parameters, and providing a plurality of primary wagering games, each having a second set of configuration parameters. In response to a change in any of the first or second sets of configuration parameters, the method dynamically compares each of the first sets with each of the second sets, in accordance with at least a first rule set, to determine which combinations of primary wagering games and progressive games are permissibly pairable. The method further displays the permissibly pairable combinations.

According to yet another aspect of the disclosure, a method of loading a primary wagering game onto a gaming device comprises receiving a request from a player of the gaming device to activate a primary wagering game, and recalling a first set of configuration parameters associated with the primary wagering game. The method further comprises comparing the first set of configuration parameters with a plurality of sets of configuration parameters associated with a plurality of progressive games, in accordance with at least one rule set. The method further comprises determining a subset of the plurality of progressive games capable of being paired with the primary wagering game, and displaying to the player the subset.

According to yet another aspect of the disclosure, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
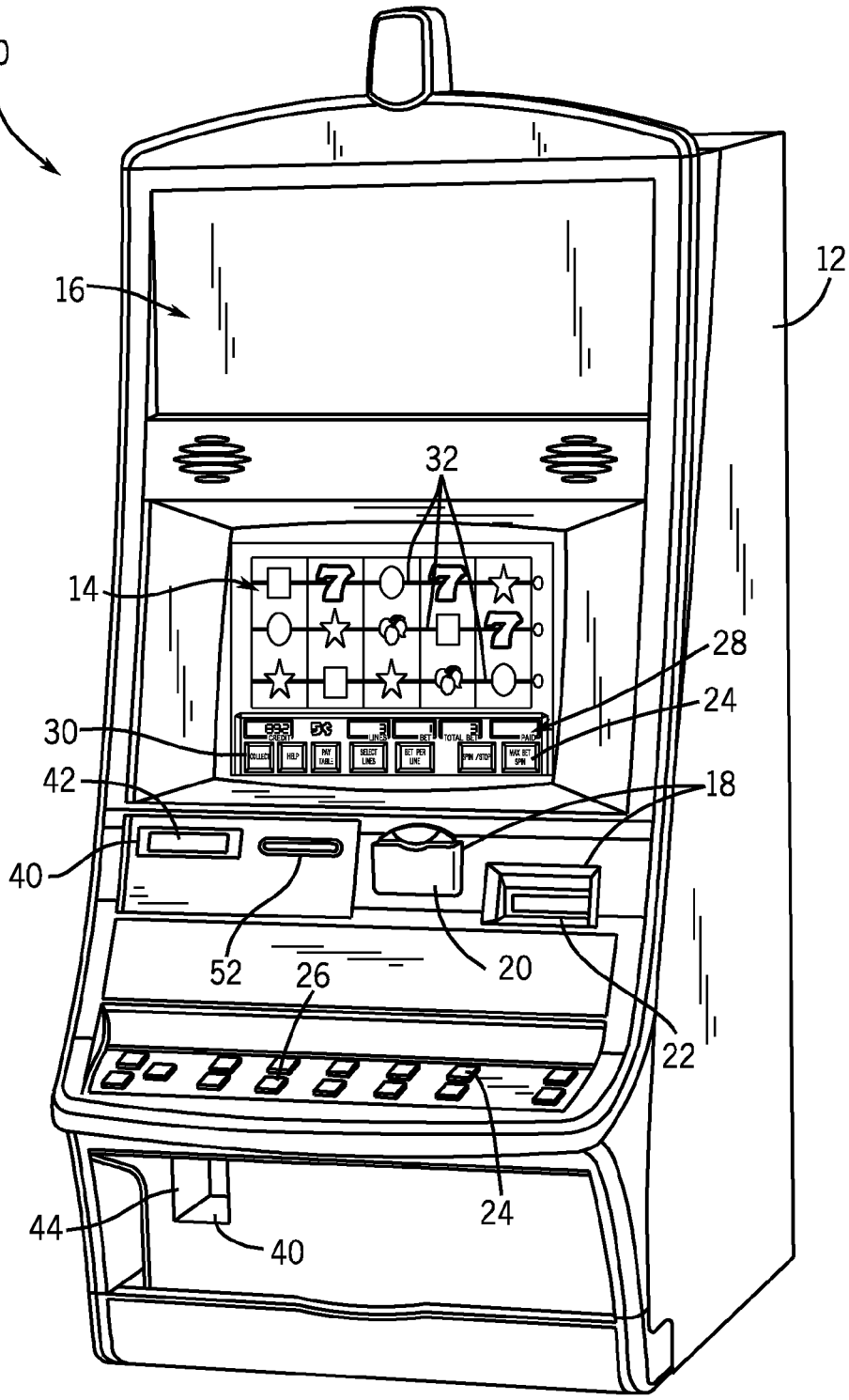
FIG. 1*a* is a perspective view of a free standing gaming machine embodying the present invention.

While this invention is susceptible of embodiment in many different forms, there are shown in the drawings and will herein be described in detail embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
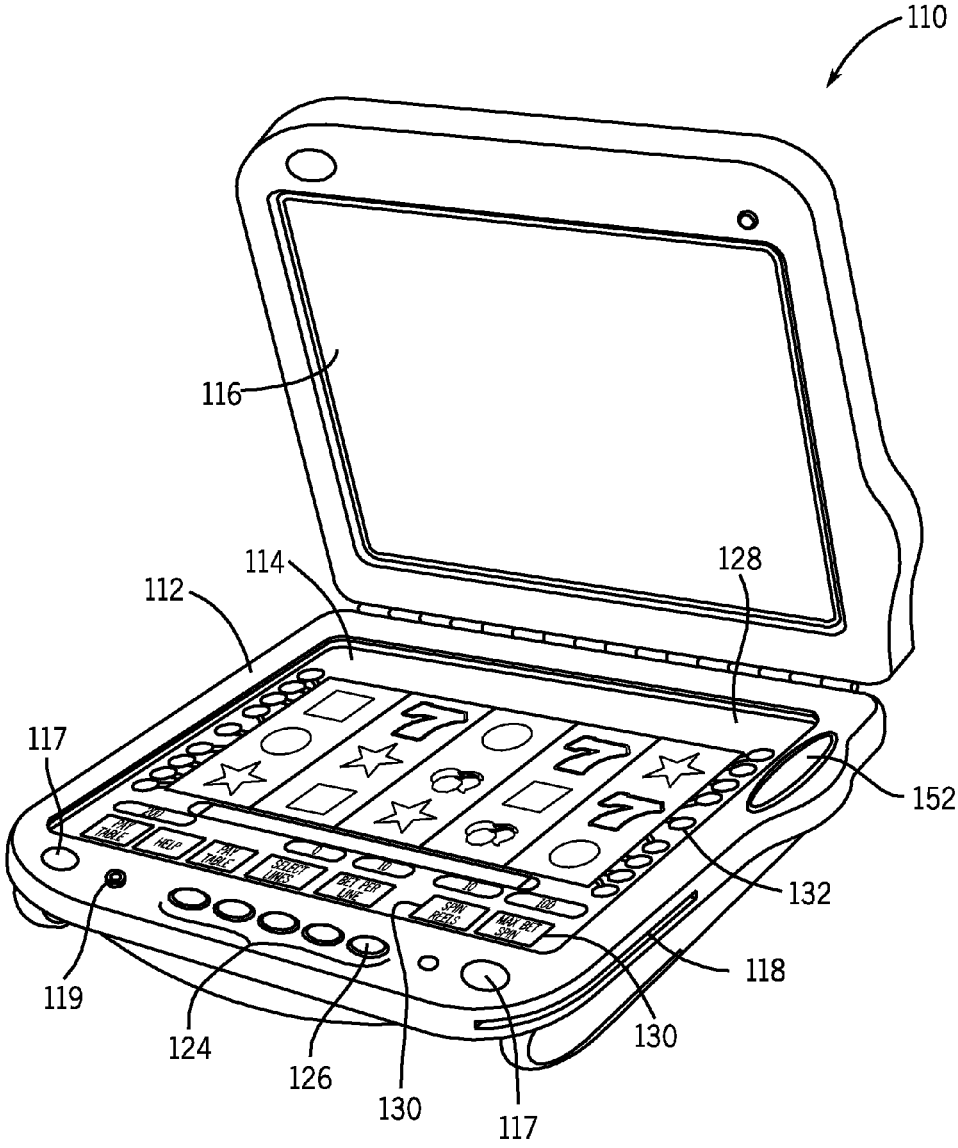
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
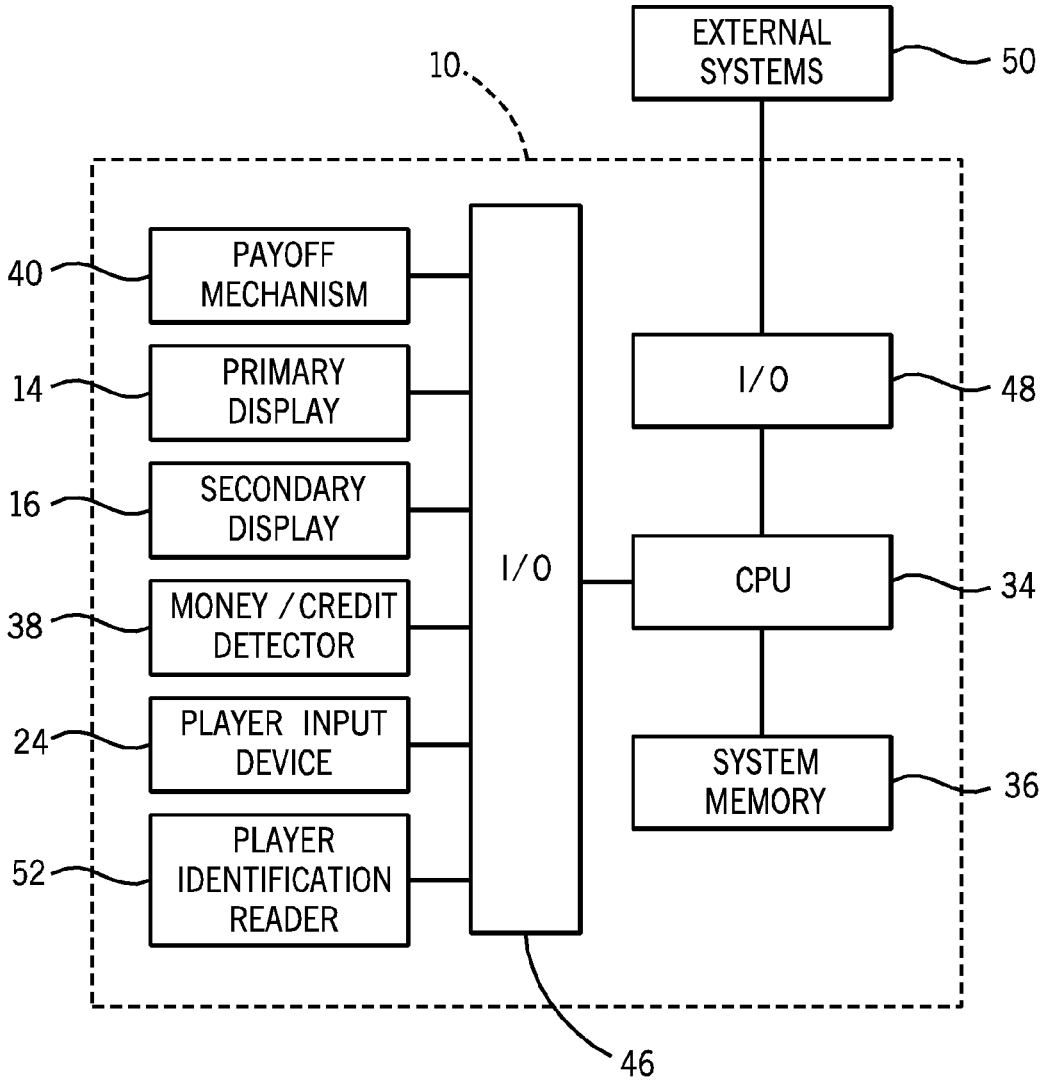
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
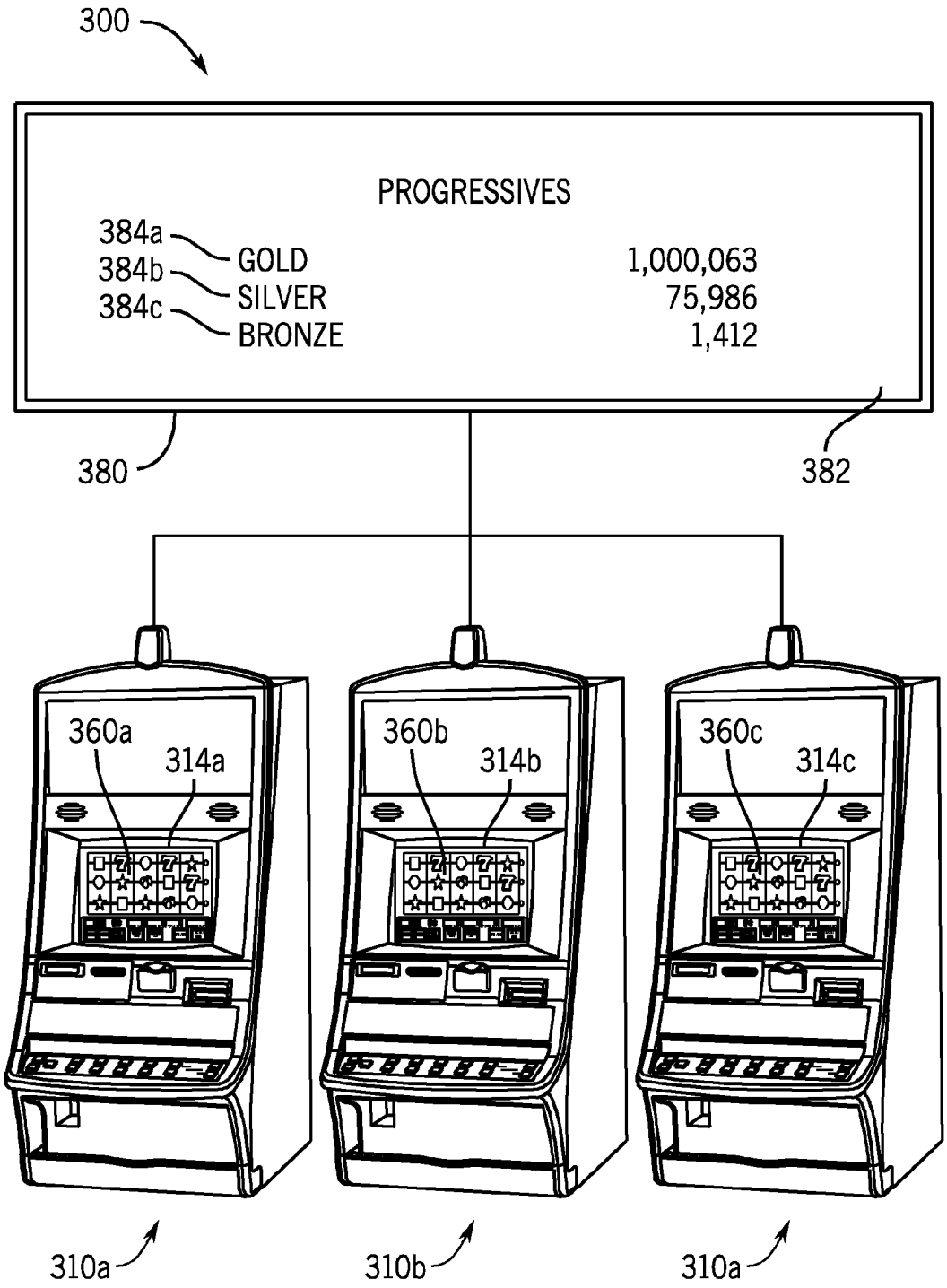
FIG. 3 is a diagram of a gaming system including mystery triggered progressive awards.

Turning to FIG. 3, a gaming system 300 including progressive awards or jackpots is displayed. The system 300 includes a plurality of gaming devices 310*a,b,c*, each of which include at least a primary display 314*a,b,c* for displaying game events thereon. Each of the primary displays 314*a,b,c* may be any form of display such as those described herein with reference to the free standing and handheld gaming devices of FIGS. 1*a* and 1*b*. The primary displays 314*a,b,c* may include display of a primary wagering game 360*a,b,c*, which in this embodiment are slot games as shown in FIG. 3. The primary wagering games 360*a,b,c* may include a plurality of reels, which may be either electro-mechanical reels or simulations thereof on the primary display 314*a,b,c*. The reels may include a plurality of symbols thereon which vary as the reels are spun and stopped. The symbols may include any variety of graphical symbols, elements, or representations, including symbols which are associated with one or more themes of the gaming machine 310*a,b,c* or system 300. The symbols may also include a blank symbol, or empty space. The primary wagering games 360*a,b,c* shown on the various primary displays 314*a,b,c* of the system 300 may be the same, similar, or different in nature, game play, theme, denomination, formation, eligibility, etc.

As described herein the symbols landing on the active paylines (the paylines for which a wager has been received) are evaluated for winning combinations. A combination of symbols that lands on an active payline is a winning outcome for which an award may be paid in accordance with a paytable of the gaming device 310*a,b,c* or system 300. The symbols on the reels form an array or matrix of symbols, having a number of rows and columns, which in the embodiment shown is three rows and five columns. In alternate embodiments, the array may have greater or fewer symbols, and may take on a variety of different forms having greater or fewer rows and/or columns. The array may even comprise other non-rectangular forms or arrangements of symbols.

The system 300 further includes a community display 380, which in this embodiment is an LCD, plasma, or other flat-screen display mounted and positioned above the plurality of gaming devices 310*a,b,c*. The community display 380 displays a progressive award event 382 which includes at least one progressive jackpot or award 384. In the embodiment shown, the progressive award event 382 comprises three levels of progressive jackpots 384 which include a GOLD level award 384*a*, a SILVER level award 384*b*, and a BRONZE level award 384*c*. When a progressive award event 382 is triggered, one or more of the progressive awards 384*a,b,c* is awarded to one or more players. In the embodiment shown, the progressive award event 382 is the display and incrementing of the jackpots 384*a,b,c*. In alternative embodiments, the progressive award event 382 may be a secondary or bonus game or event in which the player participates, interacts, or observes. One or more outcomes in such a game or event may be associated with one or more progressive awards 384. For example, the progressive award event 382 may be a picking or selection game where a player makes selections from selectable elements which are then removed to reveal underlying prizes, which may include progressive awards 384. Other configurations are possible.

In the embodiment shown in FIG. 3, the three levels of progressive awards 384*a,b,c* increase as a function of wagers input into the system 300. Thus, in an embodiment, a portion of each wager is directed to funding the progressive awards 384*a,b,c* such that the progressive awards 384*a,b,c* increase incrementally for each wager input into the system 300. The progressive awards 384*a,b,c* may be configured to increase continually until triggered or may be capped at some determined level. When triggered, each of the progressive awards 384*a,b,c* may reset to a reset value, which in an embodiment is zero credits. In alternative embodiments, other reset values may be used. Many funding schemes may be used to increment the progressive awards 384*a,b,c*.

Figure 4:
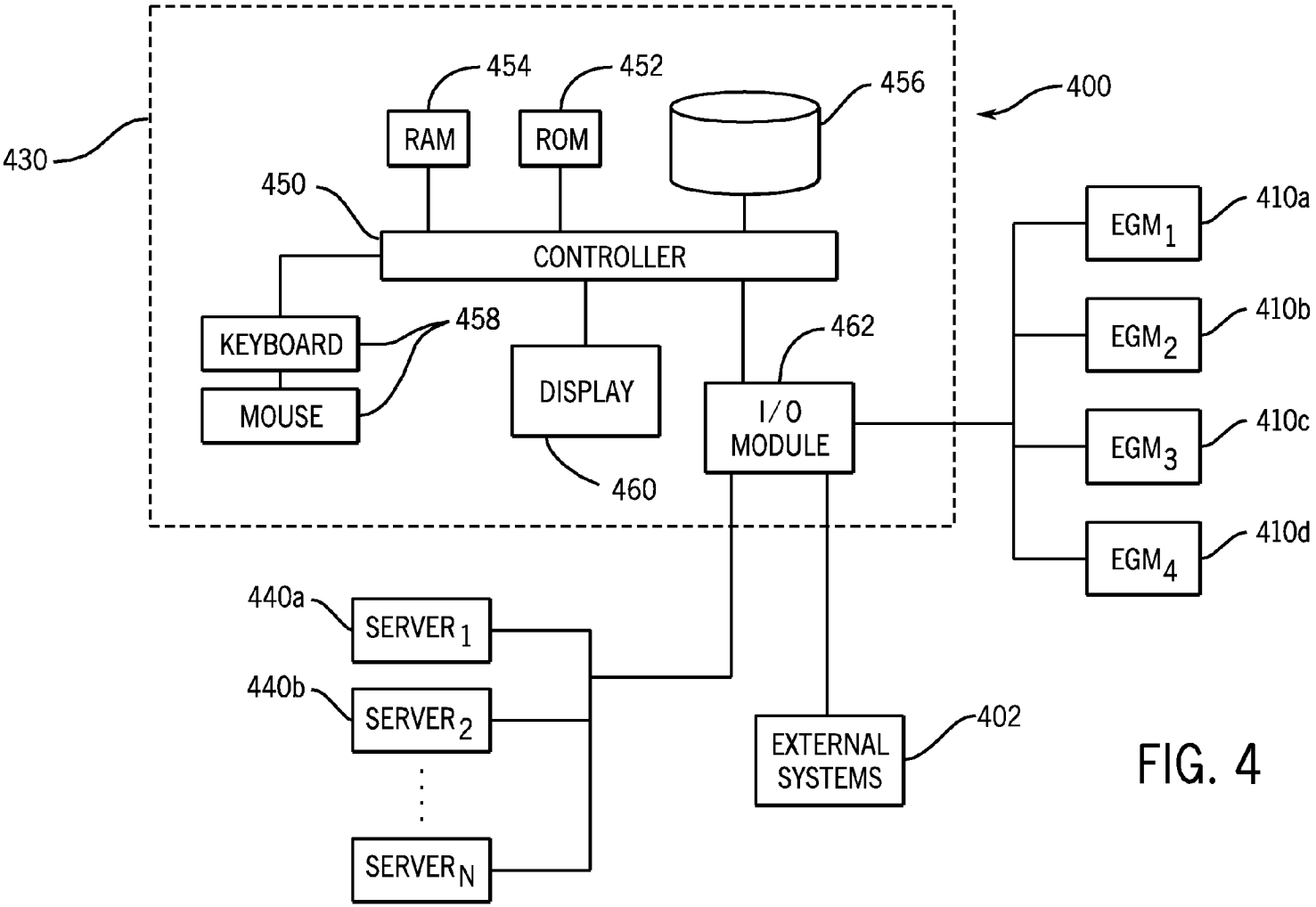
FIG. 4 is a diagram of a gaming system including a software pairing tool.

In another embodiment of the disclosure shown in FIG. 4, a gaming system 400 includes one or more gaming devices displaying wagering games (such as the primary wagering game in FIG. 3), one or more progressive games, and a tool for pairing wagering games with available progressive games on the system 400. The system 400 includes an operator control computer 430 which is in communication with a plurality of gaming devices 410*a,b,c,d* such as the gaming devices shown and described with reference to FIGS. 1*a*, 1*b* and 3. The gaming devices 410*a,b,c,d* may be either freestanding devices or handheld devices. The operator control computer 430 may further be in communication with one or more servers 440 which may store necessary data, programs, and software for the system 400.

The operator control computer 430 includes a central processing unit (microprocessor) 450 which is supported by read-only memory (ROM) 452, random access memory (RAM) 454, and a nonvolatile storage memory such as a hard drive 456. Input devices 458 such as a keyboard and/or mouse support the local entry of data and/or commands. Output devices 460 such as a monitor or display support the conveyance of information to a local operator. A communications input/output module 462 facilities bidirectional communications between the CPU 450 and external nodes over a wired or wireless communications link. As will be appreciated by those skilled in the art, the functionality provided by the structure shown in FIG. 4 is determined by the system level software and applications that provide operational control of it. Program control instructions are initially stored in ROM 452 and the hard drive 456. Following the initial boot-up process, at least part of the program control instructions is loaded into the RAM 454 to facilitate run-time operation. One or more application programs running on the structure provide higher level functionality associated with the respective nodes. For example, one or more of the servers 440*a,b* store various wagering games and provides critical recordkeeping, accounting and data support associated with the play of such wagering games.

The operator control computer 430 is configured to perform the functions of storing available wagering games, storing available progressive games, and storing and providing one or more software tools for configuring and pairing available wagering games with available progressive games, as described further herein. Moreover, the operator control computer 430 may performs a variety of other functions such as accounting tasks, metering of wagers into the system 400, etc. The operator control computer 430 may interface with other programs on the server 440, such as accounting systems, operating systems, game configuration software, etc. These functions could also be done locally on one or more of the gaming devices 410, or by other computers or external systems 462 on the system 400.

In an embodiment, one of the functions of the operator control computer 430 is to store and provide wagering games which are capable of being loaded, executed, and displayed, for example on a primary display of the gaming devices 410 of the system 400. The wagering games stored may include primary wagering games (such as the slot games shown in FIG. 3), secondary or bonus wagering games, or other gaming events. In an embodiment, the wagering games available on the system are stored on a server 440 in communication with the operator control computer 430, and executed by being loaded into memory, either on the operator control computer 430 or locally on one of the gaming devices 410. Each of the wagering games stored on the system 400 is associated with a set of configuration parameters. The configuration parameters for each wagering game may be loaded in a default state or condition, and then manipulated, adjusted, or configured accordingly by an operator or other authorized person.

The operator control computer 430 also stores and makes available on the system one or more progressive games, such as the progressive game shown in FIG. 3. As described with reference to FIG. 3, the progressive games may include progressive jackpots, multi-level progressive awards, or secondary games in which certain outcomes comprises awards of progressive awards or jackpots. Each of the progressive games stored on the system 400 and accessibly by the operator control computer 430 may be stored in a variety of locations accessible by the controller 450. In one embodiment, the progressive games are stored on a server 440 in communication with the operator control computer 430, and executed by being loaded into memory, either on the operator control computer 430 or locally on one of the gaming devices 410. In one embodiment one of the servers 440*a* may be dedicated to storing progressive games and information associated therewith, while another server 440*b* is dedicated to storing wagering games and information associated therewith.

Each of the progressive games stored on the system 400 is associated with a set of progressive configuration parameters. The configuration parameters for each wagering game may be loaded in a default state or condition, and then manipulated, adjusted, or configured accordingly by an operator or other authorized person. In an embodiment, the configuration parameters for a progressive game include reset values, contribution rates, and hit rates for each progressive game.

The operator control computer 430 executes a software pairing tool for pairing available progressive games on the system 400 with available wagering games on the system 400. The software pairing tool may be stored locally on the operator control computer 430, for example on the hard drive 456, and loaded into memory 452,454 for execution. Alternatively, the software pairing tool may be stored remotely, for example on one or more of the servers 440, and accessible to the operator control computer 430 to be loaded and executed thereon.

The software pairing too may be used to create, store, authenticate, and inform an operator as to allowable or permissible pairings of progressive games and wagering games stored and made available on the system 400. An operator may use the operator control computer 430 to select a first progressive game and change or adjust one or more of the configuration parameters for such progressive game. For example, the first progressive game may have a top award of $10,000. The operator may want to reduce the top award to $1,500 in an effort to induce excitement during play and increase the frequency that a progressive jackpot is won. The software pairing tool, in response to the change in configuration parameters of the first progressive, may be used to examine the pairings of available wagering games with the newly adjusted first progressive game. The tool may receive the adjustment to the configuration parameters of the first progressive game, and push down adjustments to the configuration parameters of available wagering games to compensate for the change. For example, to compensate for the lowered top award in the first progressive game, the associated wagering games may need to be reconfigured to have a higher hit rate for triggering the top award. Thus, the tool changes the configuration parameters of the wagering games to have an increased hit rate.

Moreover, the software pairing tool may monitor and report to an operator which wagering games are incapable of being so changed. For example, certain parameters of each wagering game on the system 400 may have acceptable ranges which are set by the operator due to preferences or perhaps relevant gaming regulations. Thus, an operator may configure a wagering game to have a hit rate within a given range. The software tool, in changing the configuration parameters of a particular wagering game to conform to the changed parameters of the first progressive, may detect that the change would result in the wagering game being placed outside of its permissible limits. The tool may then report back to the operator that the wagering game cannot be so configured so as to work with the newly reconfigured first progressive. This notifies the operator that the combination is impossible, and provides the operator an opportunity to either accept that the pairing will not be permitted, or to reconfigure either the first progressive, the wagering game, or both, until an acceptable pairing is achieved. The desired ranges and other restrictions used in comparing progressive games and wagering games may be stored in one or more rule sets which define the universe of acceptable combinations of games. The rule sets may be further modified, adjusted or created by an operator or other authorized users of the system 400.

In this way, the software pairing tool allows hypothetical comparisons of progressive jackpots with available wagering games prior to activation. The operator, using the operator control computer 430, may adjust the various configuration parameters of the progressive games loaded on the system, and receive a report as to which wagering games may be adjusted in a manner so as to continue to support a pairing with such progressive games. Alternatively, the software pairing tool may also report back as to which wagering games cannot support such a pairing, and may also make suggestions as to how the configuration parameters of a given progressive game might be adjusted so as to maximize the number of wagering games which can be successfully paired with it. The system 400 may also use the software pairing tool in the reverse. An operator may make configuration adjustments to one of the wagering games on the system 400, and receive reports and other information as to how many of the progressive games on the system 400 may be adjusted (and in what manner) so as to continue to support a pairing between the two.

In another embodiment, the system 400 and software pairing tool may be used to determine and report as to which permissible combinations of progressive games and wagering games will result given certain changes in configuration parameters. For example, a player or operator wishing to download a certain wagering game onto a gaming device 410 of the system 400 may wish to be informed as to which progressive games are available to be paired with the wagering game once downloaded. Perhaps it is further desirable to know this information in advance of downloading so as to avoid the unnecessary step of downloading if the resultant combinations are undesirable. Thus, upon receiving a request from a player or operator to activate a particular wagering game on a gaming device, the system may recall a set of configuration parameters associated with the desired primary wagering game.

Once recalled, the set of configuration parameters may be compared with the sets of configuration parameters for the plurality of progressive games available on the system, in accordance with at least one rule set. The result of the comparison is to generate a list, subset, universe or group of progressive games which are capable of being paired or coupled with the desired primary wagering game, once it is downloaded. The system can then report or display the subset of group of progressive games to the operator or player. Using this information, the operator or player can then decide whether or not to proceed with the download. Alternatively or additionally, the primary wagering game can be reconfigured in an effort to change the subset of progressive games available to be coupled. The system may also provide the reverse functionality. A desired progressive game can be selected and the system can perform a similar comparison to generate a list of available primary wagering games which are capable of being paired with the selected progressive. Other embodiments are possible as well.

Figure 5:
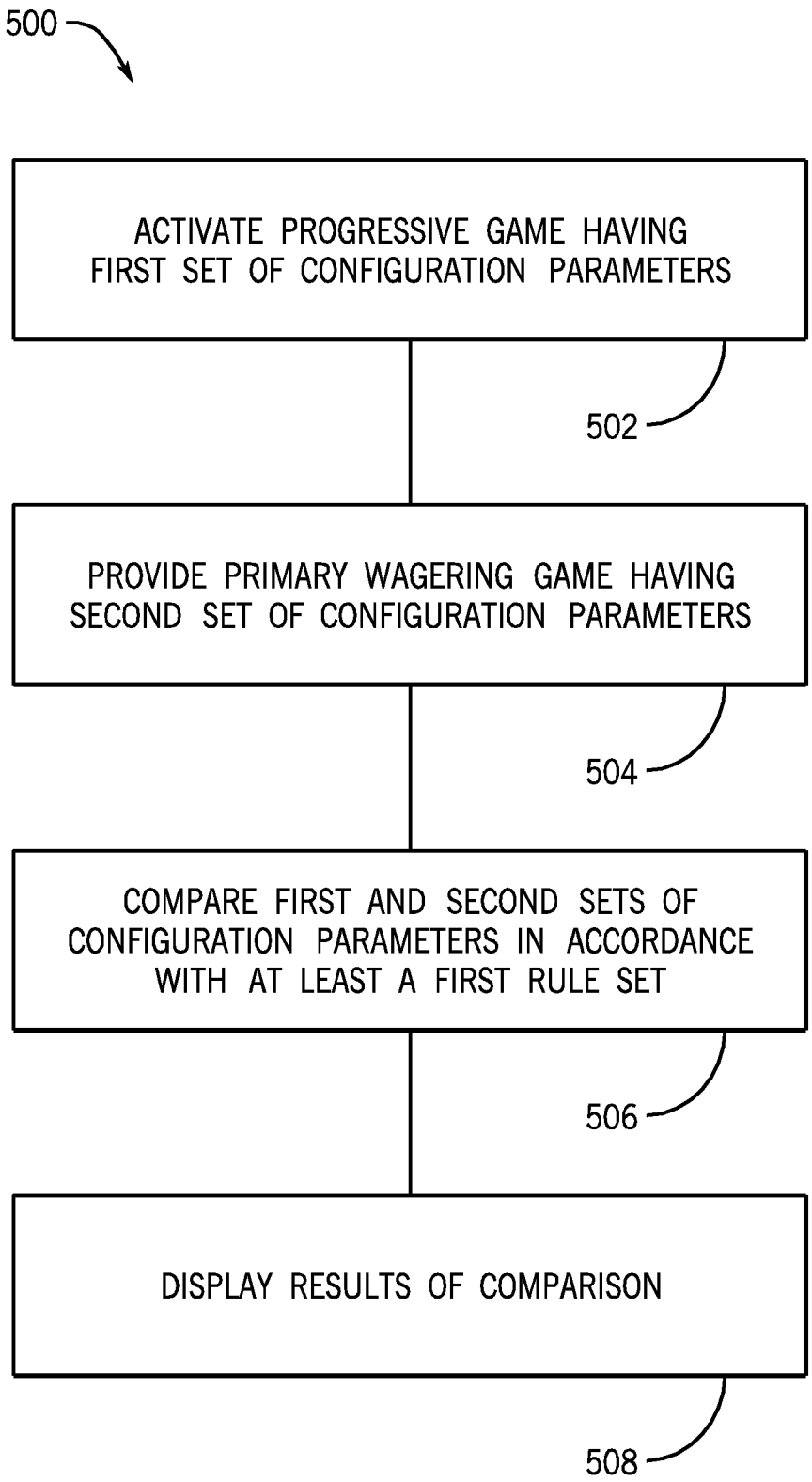
FIG. 5 is a flowchart of a method of operating a gaming system.

The systems and software pairing tool described herein can be used to perform various methods of operating a gaming system. Turning to FIG. 5, a method 500 of operating a gaming system is depicted. In step 502, a progressive game of the system is activated. The progressive game has a first set of configuration parameters. In step 504, a primary wagering game is provided on the system. The primary wagering game has a second set of configuration parameters. At step 506, the first set of configuration parameters and the second set of configuration parameters are compared in accordance with at least a first rule set. The comparison results in a determination of whether or not the primary wagering game can be activated and paired with the progressive game. At step 508, the results of the comparison are displayed.

Figure 6:
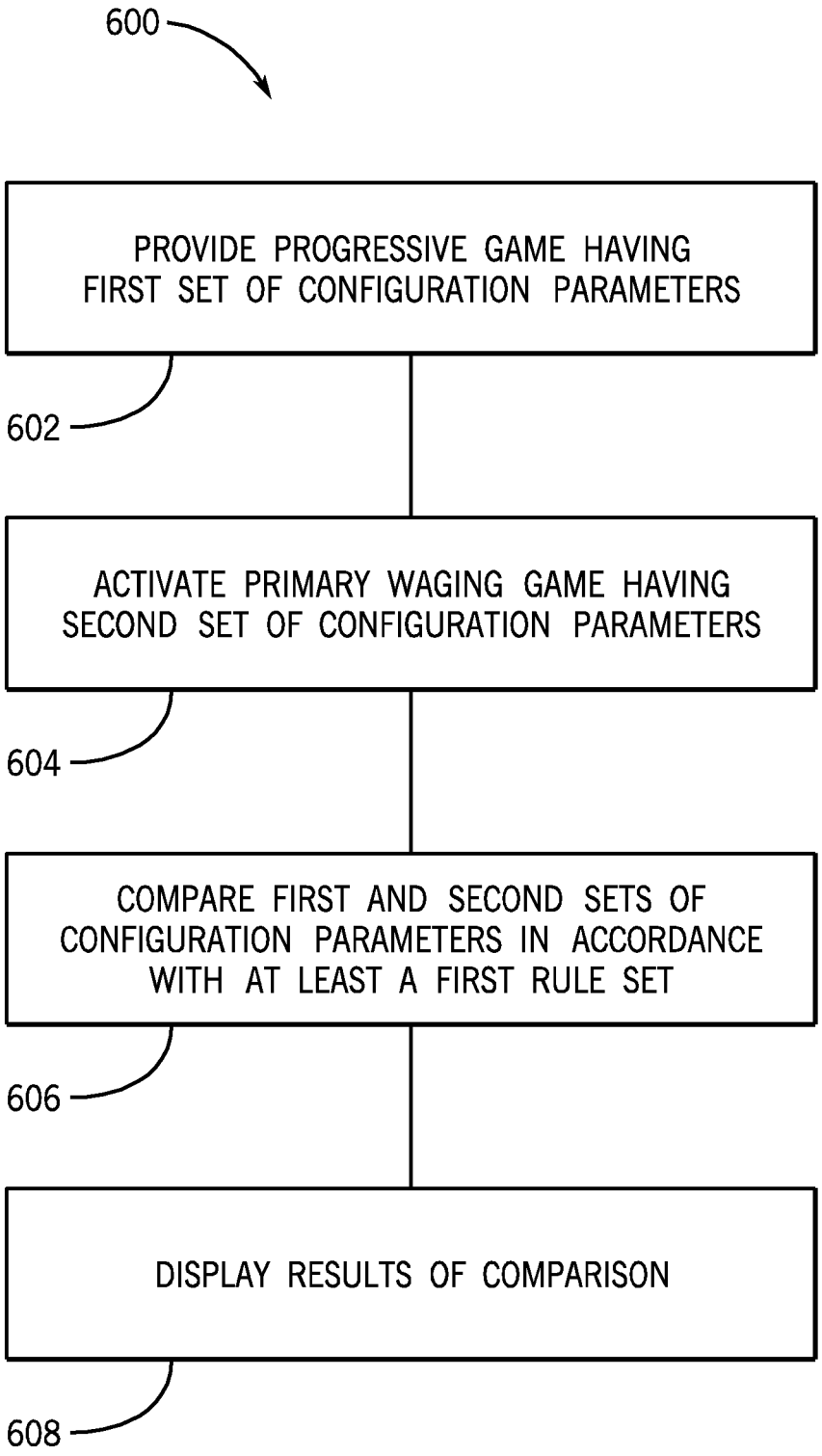
FIG. 6 is a flowchart of an alternative embodiment of a method of operating a gaming system.

Turning to FIG. 6, a method 600 of operating a gaming system is depicted. In step 602, a progressive game of the system is provided on the system. The progressive game has a first set of configuration parameters. In step 604, a primary wagering game is activated. The primary wagering game has a second set of configuration parameters. At step 606, the first set of configuration parameters and the second set of configuration parameters are compared in accordance with at least a first rule set. The comparison results in a determination of whether or not the progressive game can be activated and paired with the primary wagering game. At step 608, the results of the comparison are displayed.

Figure 7:
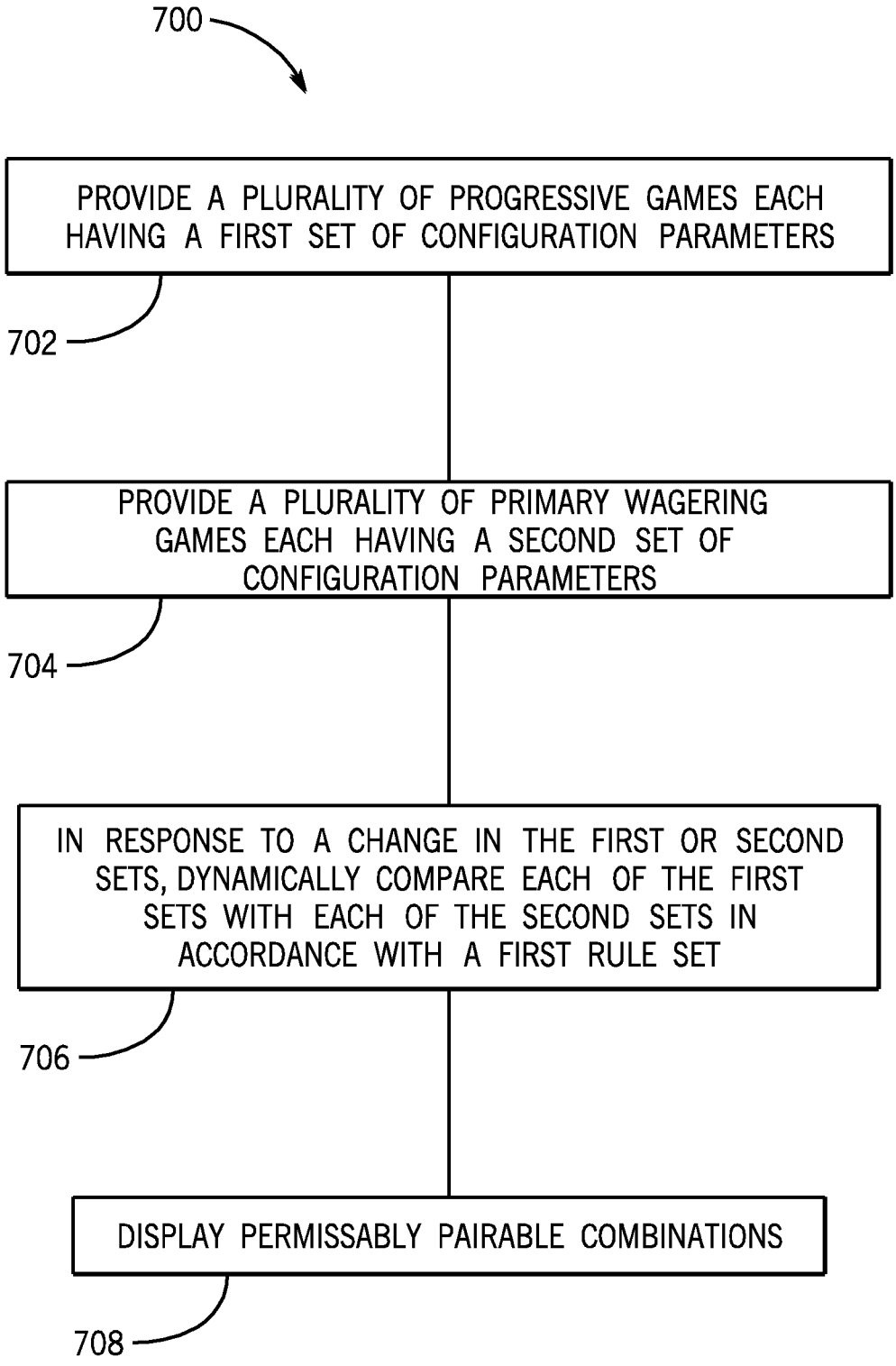
FIG. 7 is a flowchart of a method of pairing progressive games with primary wagering games.

Turning to FIG. 7, a method 700 of pairing progressive games with primary wagering games is depicted. At step 702 a plurality of progressive games are provided on a gaming system. Each progressive game has a first set of configuration parameters. At step 704, a plurality of primary wagering games are provided on the system. Each primary wagering game has a second set of configuration parameters. At step 706, in response to a change in any of the first or second sets of configuration parameters, each of the first sets and second sets are dynamically compared in accordance with at least a first rule set. The result of the comparison is to determine which combinations of primary wagering games and progressive games are permissibly pairable. At step 708, the permissibly pairable combinations are displayed.

Figure 8:
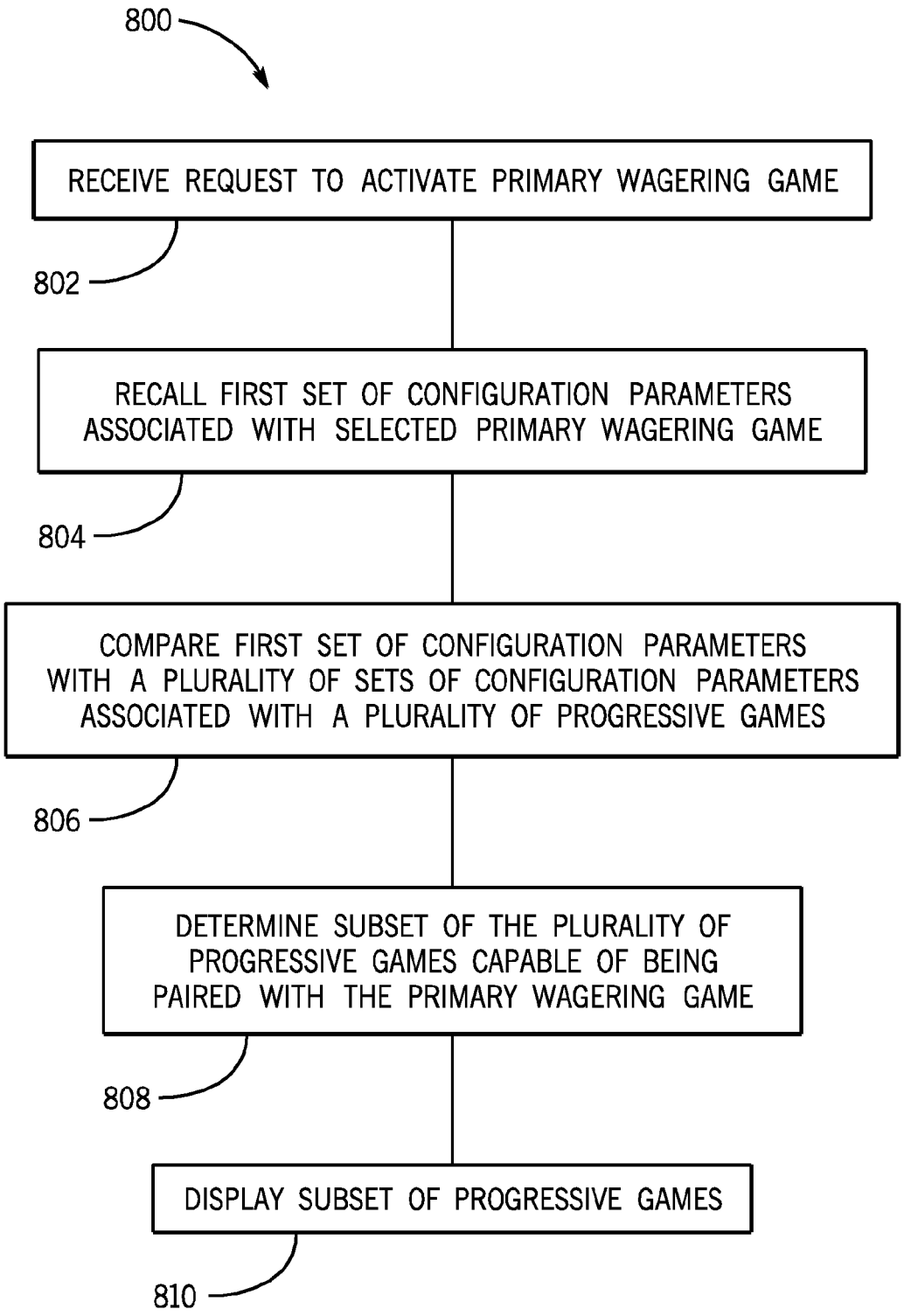
FIG. 8 is a flowchart of a method of loading a primary wagering game onto a gaming device.

The software pairing tool described herein can also be used to hypothetically pair progressive games with primary wagering games, to determine, for example, which progressive games will be available to a player who chooses to download and play a primary wagering game. This is useful, for example, if a player wants to know which progressive games will be available to him prior to downloading and running a particular primary wagering game. Thus, turning to FIG. 8, a method 800 of loading a primary wagering game onto a gaming device is shown. At step 802, a request is received from a player of the gaming device to activate a primary wagering game. At step 804, a first set of configuration parameters associated with the selected primary wagering game is recalled. At step 806, the first set of configuration parameters is compared with a plurality of sets of configuration parameters associated with a plurality of progressive games on the system. The comparison is performed in accordance with at least one rule set. At step 808, a subset of the plurality of progressive games is determined, the subset being capable of being paired with the primary wagering game. In step 810, the subset of progressive games is displayed to the player.

It should be understood that a number of variations of the methods 500,600,700,800 are possible. The steps of the methods need to be performed in any particular order. Alternative and additional steps may be included in the various methods.

The systems, devices and methods described herein offer a number of benefits and advantages over traditional gaming systems. The software pairing tool permits dynamic adjustment of wagering game configuration parameters to account for operator adjustment of configuration parameters in progressive games, and vice versa. Thus, the tool provides a dynamic system which self adjusts to inputs and changes in configuration files. In this way, an operator can be given full control over the configuration parameters of progressive games and wagering games knowing that the software pairing tool will adjust the remaining parameters to conform to the implemented rule sets and keep the system operating as desired. Other benefits as described herein are provided as well.

Each of these embodiments and obvious variations thereof is contemplated as falling within the spirit and scope of the claimed invention, which is set forth in the following claims.

What is claimed is:

1. A gaming system with one or more gaming devices for playing wagering games, the gaming system comprising:

one or more processors; and one or more memory devices storing instructions that, when executed by at least one of the one or more processors, cause the gaming system to:

store, on at least one of the one or more memory devices, a progressive game having a first set of configuration parameters;

store, on at least one of the one or more memory devices, a primary wagering game having a second set of configuration parameters; and compare, via at least one of the one or more processors, the first set of configuration parameters with the second set of configuration parameters to determine, in accordance with at least a first rule set, if the primary wagering game can be activated and paired with the progressive game.

2. The gaming system of claim 1, wherein the stored instructions further cause the gaming system to activate, on at least one of the one or more gaming devices, the primary wagering game in response to a determination that the primary wagering game can be activated and paired with the progressive game.

3. The gaming system of claim 1, wherein the stored instructions further cause the gaming system to activate, on at least one of the one or more gaming devices, the progressive game in response to a determination that the primary wagering game can be activated and paired with the progressive game.

4. The gaming system of claim 1, wherein the stored instructions further cause the gaming system to:

change one or more configuration parameters in the first set of configuration parameters; and compare, via at least one of the one or more processors, the second set of configuration parameters with the changed first set of configuration parameters to determine, in accordance at least the first rule set, if the primary wagering game can be activated and paired with the progressive game.

5. The gaming system of claim 1, wherein the stored instructions further cause the gaming system to:

receive a request to change one or more configuration parameters in the first set or the second set of configuration parameters;

determine if the requested change is permissible; and output an indication of whether the requested change is permissible.

6. The gaming system of claim 1, wherein the comparing step is performed by a software pairing tool stored on at least one of the one or more memory devices.

7. The gaming system of claim 1, wherein at least a portion of the first rule set includes rules associated with gaming regulations.

8. The gaming system of claim 1, wherein the first set of configuration parameters comprises at least one of a reset value, a contribution rate, and a hit rate.

9. The gaming system of claim 1, wherein the second set of configuration parameters comprises at least one of a payout percentage, a denomination, and a hit rate.

10. The gaming system of claim 1, wherein the progressive game is selected from a plurality of available progressive games.

11. The gaming system of claim 1, wherein the primary wagering game is selected from a plurality of available primary wagering games.

12. The gaming system of claim 1, wherein the stored instructions further cause the gaming system to display results of the comparing step.

13. The gaming system of claim 1, wherein the stored instructions, in response to a determination that the primary wagering game cannot be paired with the progressive game, cause the gaming system to output a suggested modification to the first set of configuration parameters, the second set of configuration parameters, or both, such that the primary wagering game can be paired with the progressive game.

14. One or more physical non-transitory machine-readable storage media including instructions which, when executed by one or more processors, cause the one or more processors to perform operations comprising:

activate a progressive game having a first set of configuration parameters;

provide a primary wagering game having a second set of configuration parameters;

compare the first set of configuration parameters with the second set of configuration parameters to determine, in accordance with at least a first rule set, if the primary wagering game can be activated and paired with the progressive game; and output an indication of the results from the comparing step.

15. One or more physical non-transitory machine-readable storage media including instructions which, when executed by one or more processors, cause the one or more processors to perform operations comprising:

provide a progressive game having a first set of configuration parameters;

activate a primary wagering game having a second set of configuration parameters;

compare the second set of configuration parameters with the first set of configuration parameters to determine, in accordance with at least a first rule set, if the progressive game can be activated and paired with the primary wagering game; and output an indication of the results from the comparing step.

16. A gaming system with one or more gaming devices for playing wagering games, the gaming system comprising:

one or more processors; and one or more memory devices storing instructions that, when executed by at least one of the one or more processors, cause the gaming system to:

store, on at least one of the one or more memory devices, a plurality of progressive games, each of the progressive games having a first set of configuration parameters;

store, on at least one of the one or more memory devices, a plurality of primary wagering games, each of the primary wagering games having a second set of configuration parameters;

modify the first set or the second set of configuration parameters, determine, responsive to the modifying and via at least one of the one or more processors, which combination or combinations of the primary wagering games and the progressive games are permissibly pairable in accordance with at least a first rule set; and display, via at least one display device, the permissibly pairable combination or combinations.

17. The gaming system of claim 16, wherein the stored instructions further cause the gaming system to activate, on at least one of the one or more gaming devices, a first one of the plurality of progressive games and a subset of the plurality of primary wagering games which, according to the first rule set, are permissibly pairable with the first one of the plurality of progressive games.

18. The gaming system of claim 16, wherein the stored instructions further cause the gaming system to activate, on at least one of the one or more gaming devices, a first one of the plurality of primary wagering games and a subset of the plurality of progressive games which, according to the first rule set, are permissibly pairable with the first one of the plurality of primary wagering games.

19. The gaming system of claim 16, wherein the stored instructions further cause the gaming system to determine if the modifying of the first set or the second set of configuration parameters is permissible and, if not, output an indication that the modifying is not permissible.

20. The gaming system of claim 16, wherein the stored instructions further cause the gaming system to output a suggested modification to the first set of configuration parameters, the second set of configuration parameters, or both, that will maximize a number of the primary wagering games and progressive games that are permissibly pairable.

21. The gaming system of claim 16, wherein the first set of configuration parameters comprises at least one of a reset value, a contribution rate, and a hit rate.

22. The gaming system of claim 16, wherein at least a portion of the first rule set includes rules associated with gaming regulations.

23. The gaming system of claim 16, wherein the determining step is performed by a software pairing tool stored in at least one of the one or more memory devices.

24. A gaming system with one or more gaming devices for playing wagering games, the gaming system comprising:

one or more processors; and one or more memory devices storing instructions that, when executed by at least one of the one or more processors, cause the gaming system to:

provide a plurality of progressive games, each of the progressive games having a respective first set of configuration parameters;

receive a request to activate one of a plurality of available primary wagering games, each of the primary wagering games having a respective second set of configuration parameters;

compare, via at least one of the one or more processors, the respective second set of configuration parameters of the requested primary wagering game with each of the first sets of configuration parameters associated with the plurality of progressive games;

determine, in accordance with at least one rule set, a subset of the plurality of progressive games capable of being paired with the requested primary wagering game; and display, via at least one display device, the subset of progressive games capable of being paired with the requested primary wagering game.

* * * * *